US005426959A

United States Patent [19]

Kies

[11] Patent Number: 5,426,959

[45] Date of Patent: Jun. 27, 1995

[54] GUARD FOR ENCLOSING THE SHACKLE OF A PADLOCK

[75] Inventor: Kurt Kies, 31030 Bretz Dr., Warren, Mich. 48093

[73] Assignee: Kurt Kies, Warren, Mich.

[21] Appl. No.: 289,029

[22] Filed: Aug. 11, 1994

[51] Int. Cl.[6] ..... E05B 67/38

[52] U.S. Cl. ..... 70/56; 70/417

[58] Field of Search ..... 70/51–57, 70/14, 20, 33, 63, 417, 418, DIG. 43, DIG. 56

[56] References Cited

U.S. PATENT DOCUMENTS

| | | | |
|---|---|---|---|
| 4,122,693 | 10/1978 | Barr | 70/56 |
| 4,238,941 | 12/1980 | Halopoff | 70/56 |
| 4,506,528 | 3/1985 | Eberly | 70/18 |
| 4,576,022 | 3/1986 | Gamble | 70/417 |
| 4,760,720 | 8/1988 | Grille | 70/54 |
| 4,799,369 | 1/1989 | Goodson et al. | 70/54 |
| 4,843,845 | 7/1989 | Poe | 70/54 |
| 5,146,771 | 9/1992 | Loughlin | 70/56 |

FOREIGN PATENT DOCUMENTS 2185519 7/1987 United Kingdom ..... 70/54

*Primary Examiner*—Peter M. Cuomo
*Assistant Examiner*—Tuyet Pham
*Attorney, Agent, or Firm*—Shlesinger Arkwright & Garvey

[57] ABSTRACT

A guard for enclosing the shackle of a padlock secured to a hasp staple comprises a substantially U-shaped housing comprising a front wall and spaced apart side walls connected to the front wall; and a rod connecting the side walls and spaced apart from the front wall. The rod divides the housing into upper and lower portions. The front and side walls and the rod are configured to permit the padlock to be received within the housing such that the body of the padlock is disposed below the rod and the shackle of the padlock between the rod and the front wall. The rod is positionable between the body of the padlock such that the housing is held captive to the padlock. The upper and lower portions of the housing are adapted to enclose the shackle of the padlock at least in one position of the rod between the staple hasp and the padlock body.

20 Claims, 2 Drawing Sheets

GUARD FOR ENCLOSING THE SHACKLE OF A PADLOCK

FIELD OF THE INVENTION

The present invention relates generally to a device for enclosing a padlock shackle to prevent tampering and more particularly to a guard that is held captive to the padlock by inter-engagement with the shackle and the hasp to which the padlock is secured.

BACKGROUND OF THE INVENTION

Bolt cutters, chisels, hack saws and similar burglar tools are commonly used by thieves to cut through padlock shackles and hasp staples to disable a lock and thereby gain access inside the protected premises, container or the like.

The present invention is therefore directed to a guard for a padlock that covers the front and sides of the shackle and part of the body of the padlock, thereby preventing a burglar from gaining easy access to the shackle of the padlock to cut it with a bolt cutter or the like.

OBJECTS AND SUMMARY OF THE INVENTION

It is therefore an object of the present invention to provide a guard for a padlock of either the dial or key type that prevents someone from gaining access to the shackle of the padlock.

It is another object of the present invention to provide a guard for a padlock that fits most common padlocks of various sizes of either the key or dial type.

It is yet another object of the present invention to provide a lock for a padlock that prevents both combination dial type and key type locks from being pried open, destroyed by bolt cutters and preventing a sharp blow to the body of the lock from an object such as a hammer, chisel or the like.

It is another object of the present invention to provide a guard for a padlock that can be used in any padlock application such as school lockers, gates, door hasp locks, etc.

It is another object of the present invention to provide a guard for a padlock that is adapted to be fitted to most existing lock-shackle/hasp staple installation without modification of the installation or the guard.

In summary, the present invention provides a guard for a padlock comprising a protective housing that covers the front and sides of the shackle and part of the body of the padlock and is prevented from being removed from the locked padlock by a hardened steel rod which connects both sides of the housing and prevents the housing from being slipped down over the padlock.

These and other objects of the present invention will become apparent from the following detailed description.

DETAILED DESCRIPTION OF THE INVENTION

Figure 1:
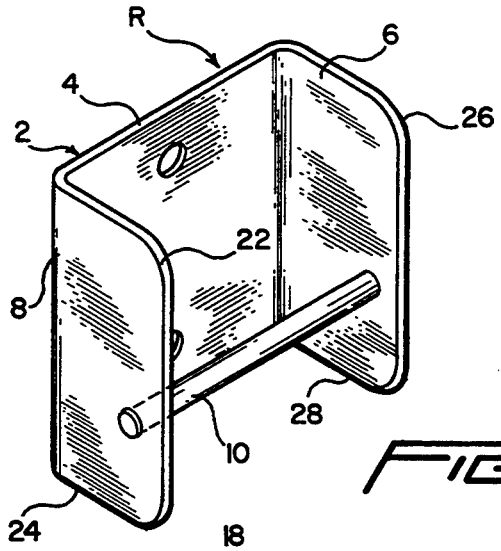
FIG. 1 is a rear perspective view of a guard made in accordance with the present invention.
Figure 2:
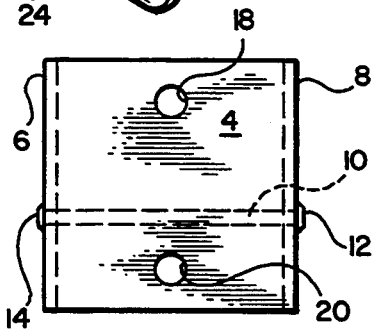
FIG. 2 is a front elevational view of the guard of FIG. 1.

A guard R for a padlock in accordance with the present invention as disclosed in FIG. 1. The guard R comprises a substantially U-shaped housing 2 with a substantially planar front wall 4 and substantially parallel spaced apart side walls 6 and 8. A hardened steel pin or rod 10 with peened ends 12 and 14 is rigidly secured to the side walls 6 and 8, as best shown in FIGS. 1 and 2. The rod 10 may also be welded at its end portions to the side walls 6 and 8. The housing 2 is preferably made from sheet metal with thickness ranging from 1.90 mm to 2.03 mm. The rod 10 is preferably 5/32 inches or 3/16 inch diameter steel.

The openings 18 and 20 are disposed near the respective outer edge of the front wall 4 for access to the dial of a combination padlock, as will be discussed below.

Figure 3:
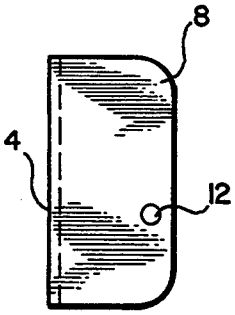
FIG. 3 is right side elevational view of FIG. 1.

The rod 10 is advantageously secured offset the mid point between the outer edges 22 and 24 of side wall 8 and outer edges 26 and 28 of the side wall 6, as best shown in FIGS. 2 and 3. By turning the housing 2 one way or the other, depending on the height of the shackle of the padlock, the housing 2 is advantageously configured to fit most commonly available padlocks.

Figure 4:
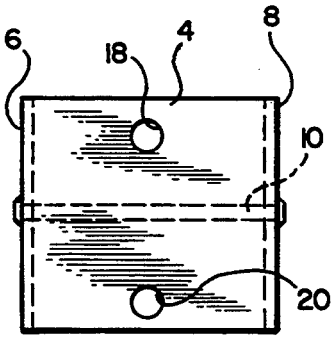
FIG. 4 is a front elevational view of another embodiment of the guard of FIG. 1.
Figure 5:
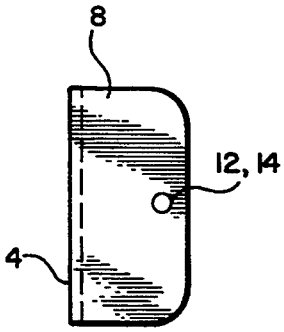
FIG. 5 is a right side elevational view of FIG. 4.

The rod 10 may also be secured exactly midway between the outer edges 22 and 24 of side wall 8 and outer 26 and 28 of the side wall 6, as best shown in FIGS. 4 and 5.

The front wall 4 and the side walls 6 and 8 are preferably rectangular and transverse to each other, as best shown in FIGS. 2 and 3.

Figure 6:
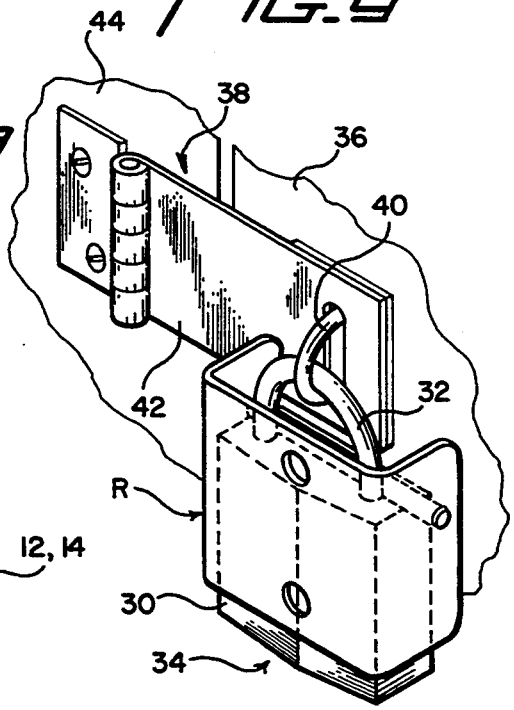
FIG. 6 is a perspective view of the guard of FIG. 1, shown installed around a padlock secured to a hasp.

The guard R protects the body 30 and shackle 32 of a key padlock 34, as best shown in FIG. 6. The padlock 34 is used to lock a door 36 with a hasp 38 comprising a staple 40 cooperating with hinged clasp 42 secured to a wall 44.

Figure 7:
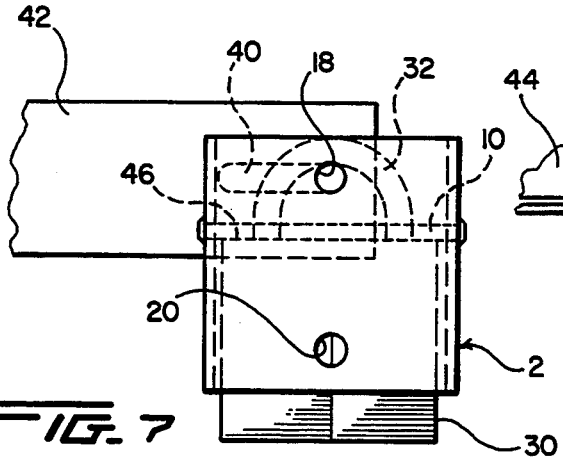
FIG. 7 is a front elevational view of FIG. 6, where the staple of the hasp is shown in a horizontal position.
Figure 8:
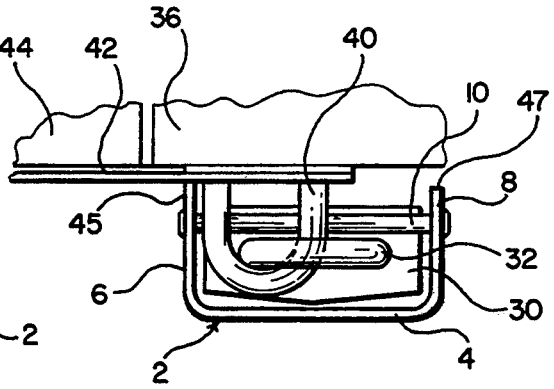
FIG. 8 is a top plan view of FIG. 7.

The housing 2 is configured such that the body 30 of the padlock 34 may be received between the front wall 4 and the side walls 6 and 8, as best shown in FIGS. 7 and 8. The rod 10 is spaced apart from the front wall 4 such that the shackle 32 may extend beyond the rod 10 when the body 30 of the padlock 34 is received within the housing 2 and prevents the body 30 from going past the rod 10, as best shown in FIGS. 7 and 8. The rod 10 serves to prevent the housing 2 from being slipped from the padlock 34 by providing a stop against the staple 40 when the housing 2 is moved upwardly and against the upper portion 46 of the body 30 when moved downwardly, as best shown in FIG. 7. Even when the housing 2 is moved upwardly or downwardly relative to the padlock body 30, the front wall 4 and the side walls 6 and 8 are configured such that the shackle 32 and the hasp 40 are not exposed. Rear edges 45 and 47 are preferably snug or substantially close to the hasp 38 to advantageously prevent rotation of the housing 2 upwardly to expose the shackle 32, as best shown in FIG. 8.

Figure 9:
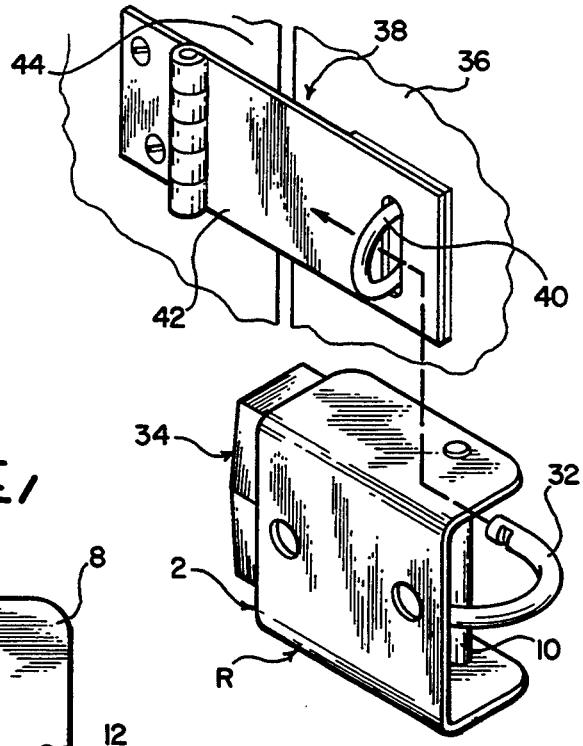
FIG. 9 is a perspective assembly view, showing the securing of a padlock equipped with the guard of the present invention to a hasp.

The padlock 34 with the guard R is secured to the hasp 38 by releasing the shackle 32 from the padlock body 30, turning the shackle substantially 90° over the rod 10, slipping the free end of the shackle 32 through the staple 40, swinging the shackle 32 back towards the padlock across the rod 10, and pressing the shackle 32 to its locked position, as best shown in FIG. 9. The guard R is then held captive to the padlock 34, thereby advantageously covering the shackle 32 and a portion of the padlock body 30, as best shown in FIGS. 7.

Figure 10:
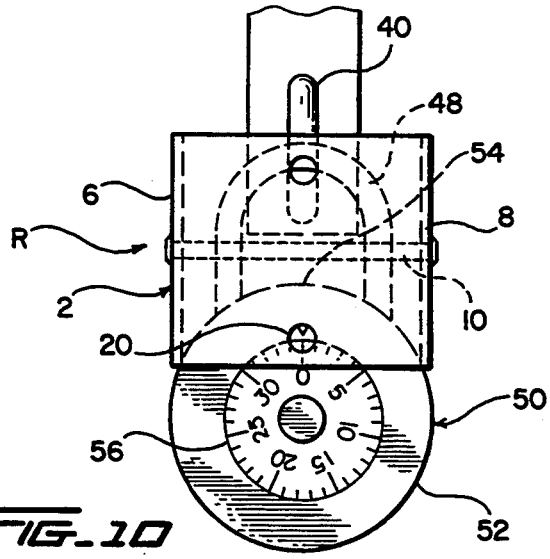
FIG. 10 is a front elevational view of a dial-type padlock with the guard of FIG. 1.
Figure 11:
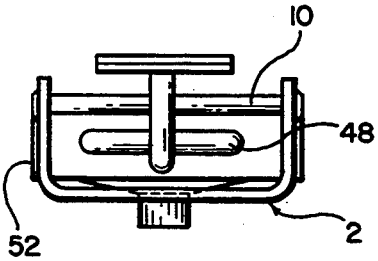
FIG. 11 is a top plan view of FIG. 10.

The guard R is also applicable for protecting the shackle 48 of a round dial-type padlock 50, as best shown in FIG. 10. The rod 10 is so disposed such that when the housing 2 is moved upwardly, the rod 10 acts as a stop against the staple 40 without exposing the shackle 48. The body 52 of the padlock 50 is round and has a diameter greater than the spacing between the side walls 6 and 8 of the housing 2, thereby supporting the housing 2 over the circumferential edge of the body 52 and advantageously preventing the housing 2 from sliding downwardly and exposing the shackle 48. If the diameter of the body 52 is smaller than the spacing between the side walls 6 and 8, the rod 10 would be offset and be resting on the top edge 54 of the body 52. The opening 20 may be advantageously positioned over the dial 56 when rotating the dial to open the padlock 50.

Figure 12:
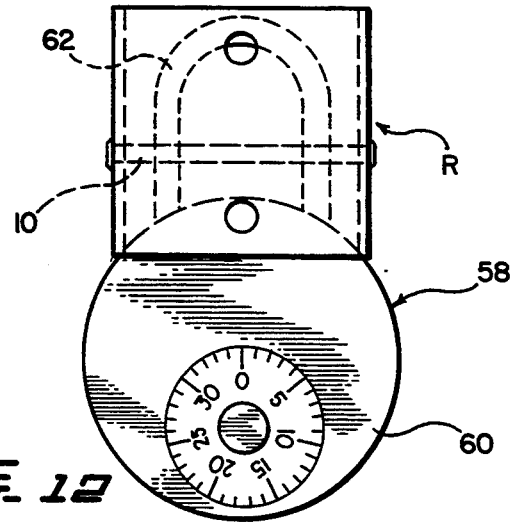
FIG. 12 is a front elevational view of a large dial-type pad lock equipped with the guard of FIG. 1.
Figure 13:
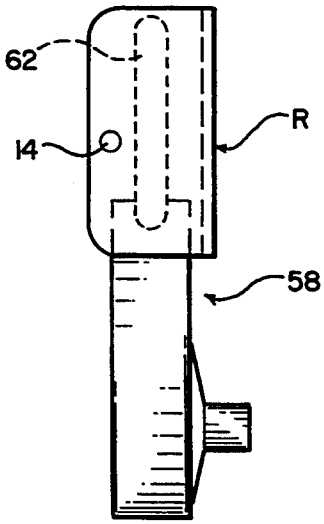
FIG. 13 is a left side elevational view of FIG. 12.

The guard R may be used with an oversized dial-type padlock 58, as best shown in FIGS. 12 and 13. The guard R has the rod 10 offset and disposed closer to the body 60 to accommodate the increased height of the shackle 62. This allows the shackle 62 to be maneuvered over and around the rod 10 when securing the padlock to the staple 40. Thus, the guard R with the offset rod 10 is able to fit a wide range of sizes of padlocks.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A guard for enclosing the shackle of a padlock secured to a hasp staple, the padlock having a body, said guard comprising:

a) a substantially U-shaped housing comprising a front wall and spaced apart side walls connected to said front wall, said housing being configured to receive the padlock therein;

b) a rod connecting said side walls and spaced apart from said front wall, thereby defining a space therebetween, said space being wide enough to allow passage of the padlock shackle and narrow enough to prevent passage of the body of the padlock;

c) said rod dividing said housing into upper and lower portions;

d) said front and side walls and said rod being configured to permit the padlock to be received within said housing such that the body of the padlock is disposed in said lower portion of said housing below said rod, and the shackle of the padlock is disposed between said rod and said front wall;

e) said housing for being secured to the padlock such that the padlock shackle is disposed between said rod and said front wall, and said rod is disposed between the body of the padlock and the hasp staple when the padlock is secured to the hasp staple, thereby holding said housing captive to the padlock; and f) said housing being adapted to enclose the padlock shackle when said housing is held captive to the padlock.

2. A guard as in claim 1, wherein:

a) said side walls includes outer edges that are snug against the hasp when said housing is installed to the padlock body, thereby preventing rotation of said housing to expose the shackle.

3. A guard as in claim 1, wherein:

a) said side walls are substantially parallel to each other.

4. A guard as in claim 1, wherein:

a) said side walls are transverse to said front wall.

5. A guard as in claim 1, wherein:

a) said side walls include upper and lower edges; and b) said rod is disposed exactly halfway between said upper and lower edges of said side walls.

6. A guard as in claim 1, wherein:

a) said side walls include upper and lower edges; and b) said rod is disposed offset from the midpoint between said upper and lower edges.

7. A guard as in claim 1, wherein:

a) said front and side walls are substantially rectangular.

8. A guard as in claim 1, wherein:

a) said front wall includes an opening.

9. A guard for enclosing the shackle of a combination dial-type padlock secured to a hasp staple, the padlock having a round body with a top portion adjacent the shackle, said guard comprising:

a) a substantially U-shaped housing comprising a front wall and spaced apart side walls connected to said front wall, said housing being configured to receive therein the padlock shackle and at least a top portion of the padlock body;

b) a rod connecting said side walls and spaced apart from said front wall, thereby defining a space therebetween, said space being adapted to allow passage of the padlock shackle;

c) said front and side walls and said rod being configured to permit a top portion of the padlock to be received within said housing such that the padlock body is disposed below said rod, and the padlock shackle is disposed within said housing between said rod and said front wall;

d) said housing for being secured to the padlock such that the padlock shackle is disposed between said rod and said front wall, and said rod is disposed between the padlock body and the hasp staple when the padlock is secured to the hasp staple, thereby holding said housing captive to the padlock; and e) said housing being adapted to enclose the padlock shackle when said housing is held captive to the padlock.

10. A guard as in claim 9, wherein:

a) said side walls include outer edges that are snug against the hasp when said housing is installed to the padlock body, thereby preventing rotation of said housing to expose the shackle.

11. A guard as in claim 9, wherein:

a) said side walls are substantially parallel to each other.

12. A guard as in claim 9, wherein:

a) said side walls are transverse to said front wall.

13. A guard as in claim 9, wherein:

a) said side walls include upper and lower edges; and b) said rod is disposed exactly halfway between said upper and lower edges of said side walls.

14. A guard as in claim 9, wherein:

a) said side walls include upper and lower edges; and b) said rod is disposed offset from the midpoint between said upper and lower edges.

15. A guard as in claim 9, wherein:

a) said front and side walls are substantially rectangular.

16. A guard as in claim 9, wherein:

a) said front wall includes an opening; and b) said opening is positionable over the dial of the padlock.

17. A guard for enclosing the shackle of a padlock secured to a hasp staple, the padlock having a body, said guard comprising:

a) a substantially U-shaped housing comprising a front wall and spaced apart side walls connected to said front wall, said housing being configured to receive the padlock therein, said side walls including upper and lower edges;

b) a rod connecting said side walls and spaced apart from said front wall, thereby defining a space therebetween, said space being wide enough to allow passage of the padlock shackle and narrow enough to prevent passage of the body of the padlock;

c) said rod being disposed offset from the midpoint between said upper and lower edges, thereby permitting said housing to fit various size shackles and padlock bodies;

d) said front and side walls and said rod being configured to permit the padlock to be received within said housing such that the padlock body is disposed below said rod, and the padlock shackle is disposed between said rod and said front wall;

e) said housing for being secured to the padlock such that the padlock shackle is disposed between said rod and said front wall, and said rod is disposed between the body of the padlock and the hasp staple when the padlock is secured to the hasp staple, thereby holding said housing captive to the padlock; and f) said housing being adapted to enclose the padlock shackle when said housing is held captive to the padlock.

18. A guard as in claim 17, wherein:

a) said side walls are substantially parallel to each other.

19. A guard as in claim 18, wherein:

a) said side walls are transverse to said front wall.

20. A guard as in claim 19, wherein:

a) said front and side walls are substantially rectangular.

* * * * *